US011395527B2

(12) United States Patent
Rankin

(10) Patent No.: US 11,395,527 B2
(45) Date of Patent: Jul. 26, 2022

(54) NO BOW LACE LOOPERS

(71) Applicant: James Rankin, Henderson, NV (US)

(72) Inventor: James Rankin, Henderson, NV (US)

( * ) Notice: Subject to any disclaimer, the term of this patent is extended or adjusted under 35 U.S.C. 154(b) by 611 days.

(21) Appl. No.: 16/520,023

(22) Filed: Jul. 23, 2019

(65) Prior Publication Data

US 2019/0343233 A1 Nov. 14, 2019

Related U.S. Application Data

(63) Continuation-in-part of application No. 15/333,608, filed on Oct. 25, 2016, now Pat. No. 10,575,590.

(51) Int. Cl.

| | |
|---|---|
| ***A43C 11/16*** | (2006.01) |
| ***A43C 11/00*** | (2006.01) |
| ***A43C 11/24*** | (2006.01) |
| ***A43C 3/02*** | (2006.01) |
| ***A43C 7/00*** | (2006.01) |
| *F21Y 115/10* | (2016.01) |
| *F21V 33/00* | (2006.01) |

(52) U.S. Cl.

CPC ..... *A43C 3/02* (2013.01); *A43C 7/00* (2013.01); *A43C 11/00* (2013.01); *A43C 11/165* (2013.01); *A43C 11/008* (2013.01); *A43C 11/24* (2013.01); *F21V 33/0004* (2013.01); *F21Y 2115/10* (2016.08)

(58) Field of Classification Search

CPC ..... A43C 7/00; A43C 11/008; A43C 11/1406; A43C 11/24; A43C 11/165; F21V 23/0414

USPC ..... 36/50.1

See application file for complete search history.

(56) References Cited

U.S. PATENT DOCUMENTS

| | | | | |
|---|---|---|---|---|
| 3,276,083 | A * | 10/1966 | Gubash | A43C 7/00 24/712.9 |
| 5,335,401 | A * | 8/1994 | Hanson | F16G 11/106 24/712.9 |
| 7,076,843 | B2 * | 7/2006 | Sakabayashi | A43C 11/165 24/68 SK |
| 7,721,468 | B1 * | 5/2010 | Johnson | A43C 1/06 36/118.1 |
| 8,713,820 | B2 * | 5/2014 | Kerns | A43C 1/04 36/88 |

(Continued)

*Primary Examiner* — Megan E Lynch
*Assistant Examiner* — Giao Quynh Thanh Hoang
(74) *Attorney, Agent, or Firm* — Weiss & Moy, P.C.; Jeffrey D. Moy

(57) ABSTRACT

A shoe lace securement system has a pair of shoe lace securing mechanisms. Each of the pair of shoe lace securing mechanisms has a spool having a pair of circular discs connected together, wherein inward facing walls of each of the pair of circular discs have a plurality of protrusions. A hollow tube connects the pair of circular discs. A conduit is attached to an upper rear area of the shoe. A stretchable strap is inserted in the conduit. A cap member is attached to each end of the stretchable strap. A pair of securing clasps are provided, each of the securing clasps comprises a tubular member having a hollow interior, the tubular member cut along a first horizontal edge through the hollow interior to a second horizontal edge, the tubular member hingly coupled at the second horizontal edge; a first opening formed through a top surface of the tubular member and in the hollow interior, and a second opening formed through a bottom surface of the tubular member and in the hollow interior.

17 Claims, 5 Drawing Sheets

(56) References Cited

U.S. PATENT DOCUMENTS

| | | | | |
|---|---|---|---|---|
| 9,743,715 | B1 * | 8/2017 | Brekke-Jones | A43C 11/06 |
| 2006/0053659 | A1 * | 3/2006 | Johnson | A43C 7/00 36/25 R |
| 2008/0086911 | A1 * | 4/2008 | Labbe | A43C 11/008 36/50.1 |
| 2010/0319216 | A1 * | 12/2010 | Grenzke | A43B 11/00 36/50.1 |
| 2016/0157561 | A1 * | 6/2016 | Schum | A43B 3/34 242/390 |
| 2018/0289110 | A1 * | 10/2018 | Bock | A43B 3/34 |

* cited by examiner

NO BOW LACE LOOPERS

The present application is a Continuation-In-Part (CIP) application of U.S. patent application entitled, "No Bow Lace Loopers", filed Oct. 25, 2016, and having U.S. Ser. No. 15/333,608 in the name of James Rankin, which is related to U.S. Provisional Application No. 62/493,012, filed Jun. 20, 2016, entitled "No Bow Lace Loopers" in the names of the James Rankin, both of which are incorporated herein by reference in its entirety.

TECHNICAL FIELD

The present invention is generally directed to the field of shoe lace securement mechanisms and in particular to a device and process whereby shoe laces can be easily secured by an operator or user to provide consistent shoe lace tension and reduce the chances of losing lace tension as well as combine an ornamental feature highly desired in contemporary footwear. The present invention contemplates a spool, a threading piece with locking mechanism, and a cap piece.

BACKGROUND

The present invention relates to shoe lace securement mechanisms that can be customized for a desired ornamental effect.

Most conventional shoes are formed with a plurality of reinforced apertures which extend longitudinally on both sides of the center of the upper from the vamp up to the ankle of the shoe. The apertures are located on the facing edges of the shoe upper directly over the tongue of the shoe. A shoelace is then laced through the apertures. The free ends of the shoelace are typically encased within small, rigid, cylindrical plastic tips which facilitate insertion of the shoelace ends through the apertures. The ends of the shoelace are first passed through the apertures adjacent to the vamp and are progressively and sequentially passed through the plurality of apertures, crossing over the tongue each time from one aperture to the next from the vamp of the shoe up to the ankle. Once the free ends of the shoelace have been threaded through the uppermost eyelets at the ankle of the shoe they are normally tied together in the form of a knot or bow.

Traditional tie up shoe lace cords can be difficult to manually tie effectively, consistently and quickly. This is constraining for either children who have not learnt to tie traditional laces into bows/knots or for people with physical handicaps, arthritis or disabilities. Furthermore, lacebows/loops being positioned on the outside of the shoe can come undone or catch on something potentially causing the wearer to trip. Additionally, the bow/knots are aesthetically unappealing and especially when tied unevenly Previous devices are deficient from the point of view of a consumer with a desire to quickly, easily, and simply maintain adequate tension while securing shoe laces. Further, some current devices require a combination of mechanics to increase the tension, greatly increasing the production cost of a shoe. The present invention is based off an easily produced and simple design capable of being configured as a removable shoe accessory or incorporated into the design of a shoe.

Some examples of the variety of devices which secure or tighten shoe laces or the like can be summarized in the following. One type of machine, shown in U.S. Pat. No. 5,157,813, uses a crank driven device affixed to the tongue of a shoe to increase the tension of the laces through rotation.

Laces are fed through the rotation device which is turned to increase tension. A spring operates to prevent the tension from becoming too high and causing discomfort. This prior art is a good example of a tightening mechanism, but this device is mechanically complex, difficult to produce, and aesthetically unappealing.

Other machines provide motor powered tightening. For instance, U.S. Pat. No. 7,752,774 is an automatic shoe lace tightening system. This machine is meant to be operated via a switch with a motor and spool whereby the laced wrap around the spool and increase lace tension for the user. Clearly, this machine is an expensive product that must be integrated within the shoe, preventing interchangeability between commonly available shoes and increasing maintenance costs. In contrast, the present invention can be manufactured with extremely low cost and can be placed in any shoe with laces at the consumer level or, alternatively, directly incorporated into the manufacturer's design.

Accordingly, it would be advantageous to provide a device that is designed as an inexpensive and interchangeable customer installed shoe lace securement mechanism which maintains shoe lace tension, does not require production level integration or expensive mechanical parts, is operable by persons unable to tie a knot, and maintains or increases aesthetic appeal.

As such, the present invention considers the shoe lace securement mechanisms of the past but improves on their goals by integrating the features of the present invention. No other device provides for lace securement without mechanical means that is easily manufactured, easily installed by a consumer in any conventional laced shoe, and maintains the aesthetic appeal of the shoe.

SUMMARY

The present invention is generally directed to the field of shoe lacesecurement mechanisms and in particular to a device and process whereby shoe laces can be easily secured by an operator or user to provide consistent shoe lace tension and reduce the chances of losing lace tension as well as combine an ornamental feature highly desired in contemporary footwear. In an embodiment, the invention contemplates four pieces: a spool, a threading piece with locking mechanism, a cap piece, and an ornamental casing.

A spool is comprised of two disc-shaped edges connected via a centrally located hollow tube. A hollow tube is configured to accept a central protrusion from the threading piece with locking mechanism. A plurality of radially located protrusions are interspersed equidistantly on the inward facing walls of each disc shaped edge surface. Each protrusion is aligned with its sister protrusion on the opposing inward facing wall of the disc shaped edges but leaves sufficient space to permit a shoe lace to penetrate to the hollow central tube. The outward facing disc-shaped edge contains a circular depression and two vertical protrusions in the center where the hollow tube emerges.

A threading piece with locking mechanism is comprised of a disc shaped piece and a solid protrusion extending perpendicular to the disc shaped piece. A solid protrusion is configured to traverse the hollow tube of the spool. A distal end of the protrusion provides for a locking mechanism whereby the protrusion is shaped as a rectangle. Once a distal end of a protrusion emerged from a centrally located hollow tube of the spool, it can be rotated approximately ninety degrees to prevent the protrusion from slipping back through the hollow tube.

A cap piece is comprised of an ovular shaped piece with crescent indentations which is to be placed on top of a distal end of the protrusion when it has traversed the hollow tube of a spool. A centrally located male insertion piece rises from the inward facing wall of the cap piece that fits into a female receptor of the distal end of the protrusion. Once mated, any torque applied to the threading piece will be transferred to the cap piece which prevents rotation by contact with two vertical protrusions on the outward facing disc-shaped circular depression. A cap piece will be secured to the spool via a flexible material that will run from the outer facing wall of the disc shaped edge closest to the shoe.

An ornamental casing will be affixed to the outer facing wall of a spool with a central depression to permit a cap piece to mate with a distal end of a protrusion. An ornamental casing will be comprised of a translucent plastic and will contain a plurality of light-emitting diodes ("LED") and a power source. A plurality of LEDs can be variably configured to illuminate a logo, character, number, symbol, or image affixed to the surface of the ornamental casing as required. Additionally, or alternatively, a plurality of LEDs can be illuminated in different colors or at varying intervals. The LEDs can be activated by a switch or other common activation method located on the ornamental casing.

A present and primary embodiment envisions usage by placing the threading piece with locking mechanism on the inside of a shoe at the highest located aperture. A spool is placed on the opposing side of the same aperture. A threading piece is fed through an aperture and a spool. A threading piece is then rotated ninety degrees. A cap piece is then placed on a distal end of a protrusion. The same process is repeated on the opposite side of the shoe with a second device.

A user will then manually tighten shoe laces to the desired tension level. At the desired tension level, a user will align a shoe lace with a spool and begin to wrap the shoe laces around a spool. The surface friction of the laces on the spool will prevent any loss of tension. Additionally, radially dispersed protrusions on the inner facing walls of a spool will add additional friction by keeping the shoe lace compressed around the spool.

In accordance with one embodiment, a shoe lace securement system is disclosed. The shoe lace securement system has a pair of shoe lace securing mechanisms. Each of the pair of shoe lace securing mechanisms has a spool having a pair of circular discs connected together, wherein inward facing walls of each of the pair of circular discs have a plurality of protrusions. A hollow tube connects the pair of circular discs. A conduit is attached to an upper rear area of the shoe. A stretchable strap is inserted in the conduit. A cap member is attached to each end of the stretchable strap. A pair of securing clasps are provided, each of the securing clasps comprises a tubular member having a hollow interior, the tubular member cut along a first horizontal edge through the hollow interior to a second horizontal edge, the tubular member hingly coupled at the second horizontal edge; a first opening formed through a top surface of the tubular member and in the hollow interior; and a second opening formed through a bottom surface of the tubular member and in the hollow interior.

This summary is not intended to identify key features or essential features of the claimed subject matter, nor is it intended to be used as an aid in determining the scope of the claimed subject matter. Additional features and advantages of exemplary implementations of the present disclosure will be set forth below, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

An embodiment of the present invention will hereinafter be described in conjunction with the appended drawings, provided to illustrate and not to limit the invention, in which.

DESCRIPTION OF THE APPLICATION

The description set forth below in connection with the appended drawings is intended as a description of presently preferred embodiments of the disclosure and is not intended to represent the only forms in which the present disclosure can be constructed and/or utilized. The description sets forth the functions and the sequence of steps for constructing and operating the disclosure in connection with the illustrated embodiments. It is to be understood, however, that the same or equivalent functions and sequences can be accomplished by different embodiments that are also intended to be encompassed within the spirit and scope of this disclosure.

Figure 1:
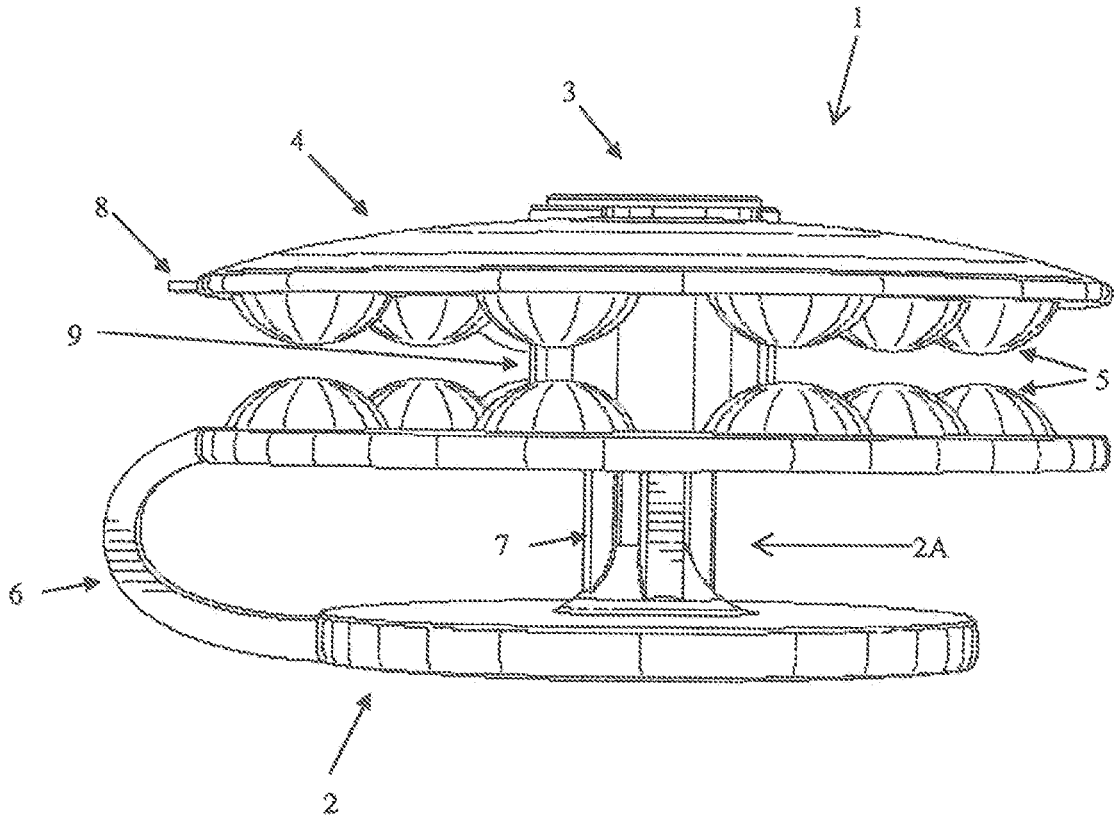
FIG. 1: is a side perspective view of the shoe lace securement mechanism with the spool, the threading piece with locking mechanism, the cap piece, and an ornamental casing.

FIG. 1 depicts a side perspective view of the shoe lace securement mechanism with the spool 1, the threading piece with locking mechanism 2, and the cap piece 3, and an ornamental casing 4. All elements listed in a certain embodiment are modular and not specific to all embodiments of the present invention.

A certain embodiment of a lace securement mechanism includes a spool 1 comprised of two disc-shaped edges 15 connected via a centrally located hollow tube 9. The hollow tube 9 is configured to accept a central protrusion 7 from the threading piece 2 with locking mechanism 2A. The hollow tube 9 permits passage of the central protrusion 7 of the threading piece 2 only when properly aligned. A plurality of radially located protrusions 5 are interspersed equidistantly on the inward facing walls 15A of each disc shaped edge 15 of the spool 1. These protrusions 5 are of variable shape and are designed to increase the compressive force against the shoe lace as it is wrapped around the spool 1. Additionally, these protrusions 5 can be configured to have a rough exterior to increase friction with the shoe lace as torque is inadvertently applied to the shoe laces. Each protrusion 5 is aligned with its sister protrusion on the opposing inward facing wall 15A of the disc shaped edges 15 but leaves sufficient space to permit a shoe lace to penetrate to the hollow central tube of the spool 1 when sufficient force is manually applied by the user. The outward facing wall 15B of the disc-shaped edge 15 contains a circular depression and two vertical protrusions 12 in the center where the hollow tube 9 emerges to prevent the rotation of the cap piece 3 when affixed to the distal end 14 of the threading piece 2.

The threading piece 2 with locking mechanism 2A is comprised of a disc shaped piece and a solid protrusion 7 extending perpendicular to the disc shaped piece. The solid protrusion 7 is configured to traverse the hollow tube of the spool 1 only when properly aligned. The distal end of the protrusion 14 provides for a locking mechanism whereby the protrusion 7 is shaped as a rectangle or other suitable shape with an indentation configured to receive a male insertion component from the cap piece 3. Once the distal end of the protrusion 14 emerged from the centrally located hollow tube of the spool 1, it can be rotated approximately ninety degrees to prevent the protrusion 7 from slipping back through the hollow tube 9. The threading piece 2 will be secured to the spool 1 via a flexible material 6 that will run from the side facing wall of the disc shaped edge 15 closest to the shoe to the side wall of the threading piece. This strap 6 will prevent rotation of the device of more than one rotation by physical contact with the shoe lace.

The cap piece 3 is comprised of configured shape to fit in the depression 18 on the outward facing wall 15B of the spool 1 such as the ovular shaped piece with crescent indentations to be placed on top of the distal end of the protrusion 14 when it has traversed the hollow tube of the spool 1. A centrally located male insertion piece 16 rises from the inward facing wall of the cap piece 3 fits into a female receptor 17 of the distal end of the protrusion. Once mated, any torque applied to the threading piece 2 will be transferred to the cap piece 3 which prevents rotation by contact with two vertical protrusions 12 on the outward facing disc-shaped circular depression. The cap piece 3 may be secured to the spool 1 via a flexible material that will run from the outer facing wall 15B of the disc shaped edge 15 closest to the shoe.

The ornamental casing 4 will be affixed to the outer facing wall of the spool 1 with a central depression to permit the cap piece to mate with the distal end of the protrusion. The ornamental casing will be comprised of a translucent plastic and will contain a plurality of light-emitting diodes 11 ("LED") and a power source 10. The plurality of LEDs 11 can be variably configured to illuminate a logo, character, number, symbol, or image affixed to the surface of the ornamental casing as required. Additionally, or alternatively, the plurality of LEDs 11 can be illuminated in different colors or at varying intervals. The LEDs can be activated by a switch 8 or other common activation method located on the ornamental casing 4.

A present and primary embodiment envisions usage by placing the threading piece with locking mechanism 2 on the inside of a shoe at the highest located aperture configured to receive a shoe lace. The spool 1 is placed on the opposing side of the same aperture. The threading piece 2 is fed through the aperture of the shoe and the spool 1. The threading piece 2 is then rotated ninety degrees. The cap piece 3 is then placed on the distal end of the protrusion 7. The same process is repeated on the opposite side of the shoe with a second device.

A user will then manually tighten the shoe laces to the desired tension level. At the desired tension level, a user will align the shoe lace with the spool 1 and begin to wrap the shoe laces around the spool 1 in a circular motion. The surface friction of the laces on the spool 1 will prevent any loss of tension in the shoe lace. Additionally, the radially dispersed protrusions 5 on the inner facing walls of the spool 1 will add additional friction by keeping the shoe lace compressed around the spool.

Figure 2:
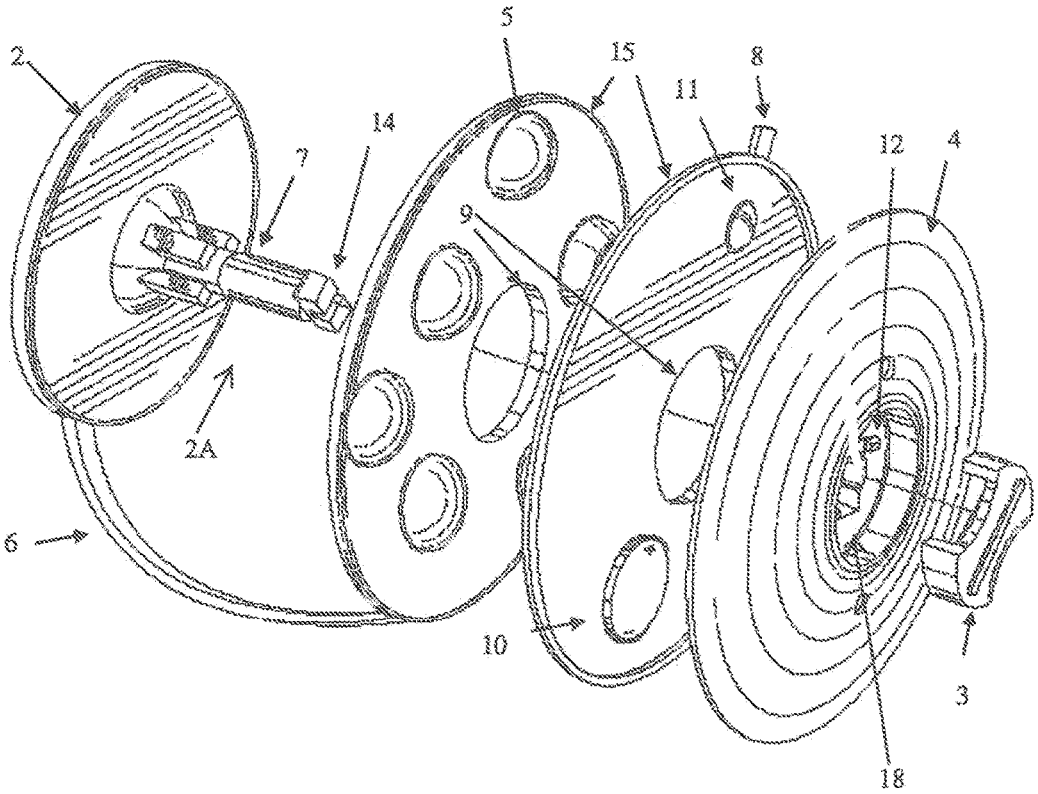
FIG. 2: is a front exploded view of the shoe lace securement mechanism with the spool, the threading piece with locking mechanism, the cap piece, and an ornamental casing.
Figure 3:
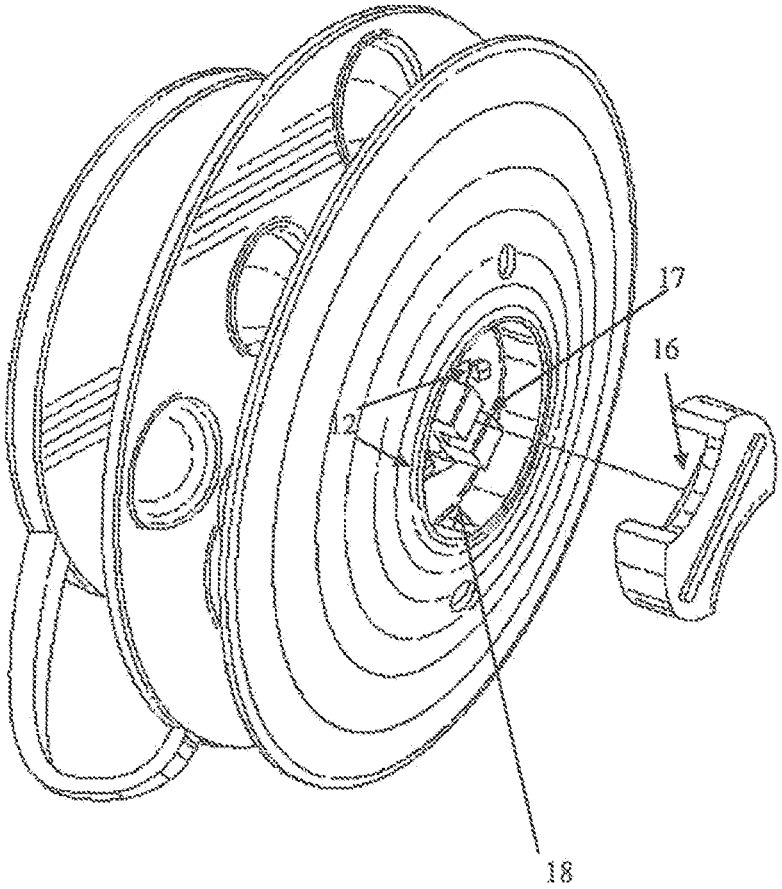
FIG. 3: is a perspective view of the shoe lace securement mechanism with the threading piece with locking mechanism inserted through the spool.
Figure 5:
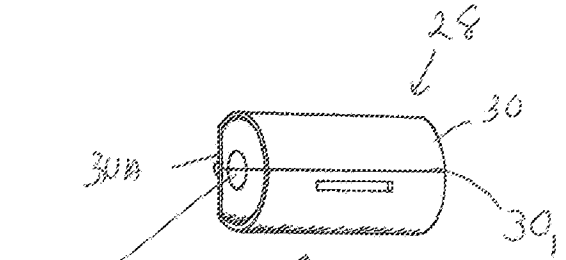
FIG. 5 is a perspective of an exemplary embodiment of a securing mechanism in a closed position used in the lace securement system of FIG. 4 in accordance with one embodiment of the present invention.
Figure 4:
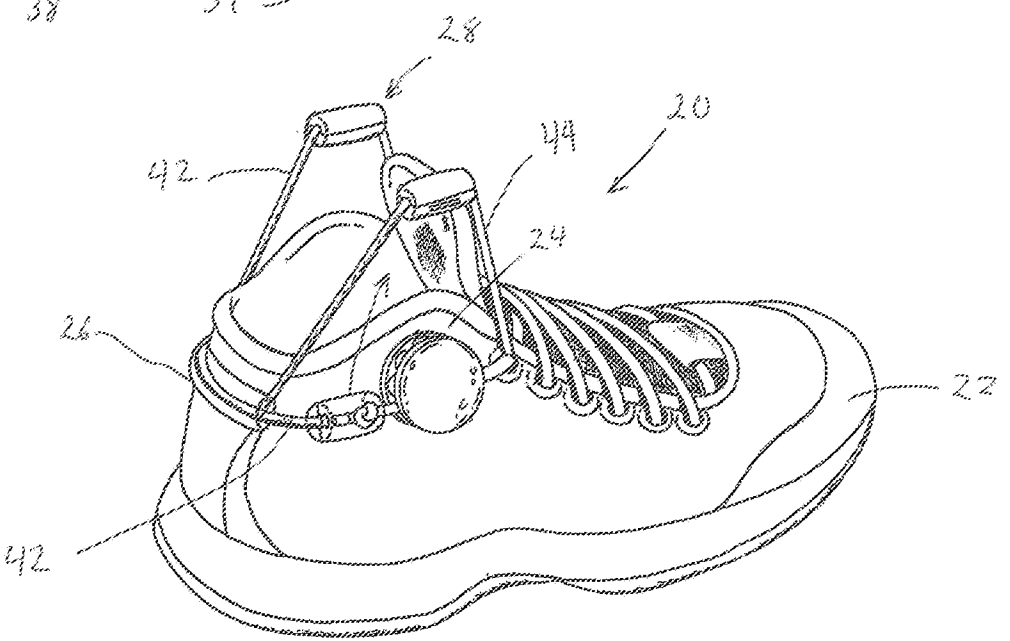
FIG. 4: is a perspective view of an exemplary embodiment of a lace securement system using the shoe lace securement mechanism of FIG. 1 in accordance with one embodiment of the present invention.
Figure 6:
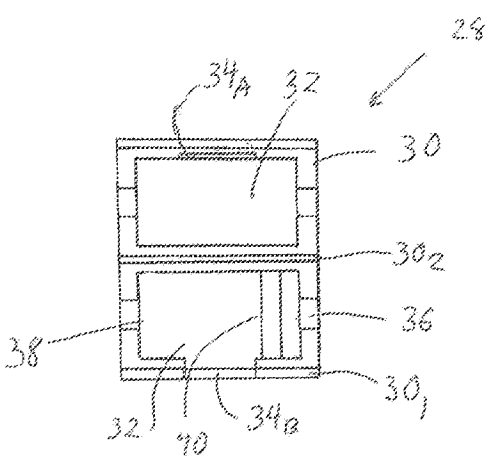
FIG. 6 is a top perspective of an exemplary embodiment of the securing mechanism of FIG. 5 in an open position in accordance with one embodiment of the present invention.
Figure 7:
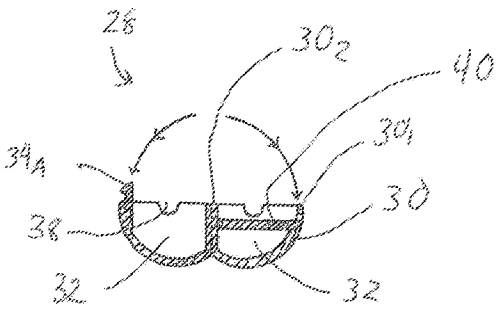
FIG. 7 is a cross-sectional view of an exemplary embodiment of the securing mechanism of FIG. 6 in an open position in accordance with one embodiment of the present invention.
Figure 8:
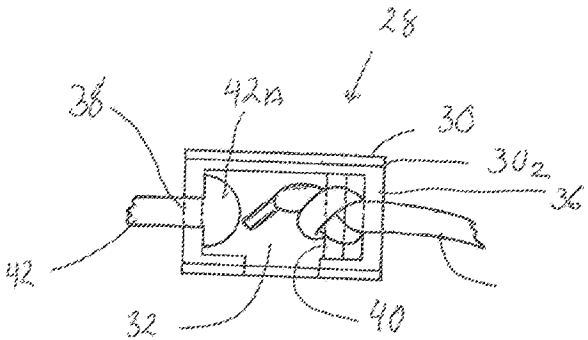
FIG. 8 is a cross-sectional view of an exemplary embodiment of the securing mechanism of FIG. 5 in accordance with one embodiment of the present invention.

Referring to FIGS. 4-9, a lace securement system 20 may be seen. The lace securement system 20 may use the lace securement mechanism shown in FIGS. 1-3. The lace securement system 20 may incorporate the lace securement mechanism into a shoe 22. The lace securement mechanism may be placed by a manufacturer at the highest aperture on the wall 24 of the shoe 22 on each side of the shoe 22.

In the present embodiment, in the lace securement mechanism, instead of placing a removable cap 3 on the protrusion 7 of the threading piece 2, the threading piece 2 can be integrated into the side wall of the shoe 22 via sewing or molding techniques commonly known in the art. As a result of this integration, the flexible material 6, shown in FIGS. 1-3, that runs from the side facing wall of the disc shaped edge closest to the shoe 22 to the side wall of the threading piece is not required.

In addition to the lace securement mechanism positioned on each side of the shoe 22, the lace securement system 20 may have a conduit 26. The conduit 26 may be attached to an upper rear section of the shoe 22. In accordance with one embodiment, the conduit 26 may be comprised of flexible material affixed to the rear of a heel area of the shoe 22. The conduit 26 may extend a circumference of the heel area and vertically aligned with the lace securement mechanism.

The lace securement system 20 may have a securing clasp 28 affixed to the heel of the shoe laterally located to the lace securement mechanism. The securing clasp 28 may be comprised of a tubular member 30. The tubular member 30 may have a flat rear surface 30A. The tubular member 30 may be cut along a horizontal axis allowing the tubular member 30 to be open and to expose a hollow interior area 32 of the tubular member 30. The tubular member 30 may be cut along a first horizontal edge 301 of the tubular member 30 and through the tubular member 30 while allowing a second horizontal edge 302 opposite of the first horizontal edge 301 to remain connected. This may allow the tubular member 30 to be hinged along the second horizontal edge 302.

A latch mechanism 34 may be formed a first horizontal edge 301 of the tubular member 30. The latch mechanism 34 may be used to secure and release the tubular member 30 in an open and closed positions. In the present embodiment, the latch mechanism 34 may be formed of a male tab member 34A and a female channel 34B. The male tab member 34A may be formed on a first surface of the first horizontal edge 301. The female tab member 34B may be formed on a second surface of the first horizontal edge 301 which opposes the first surface. Securing the male tab member 34A within the female channel 34B may lock the tubular member 30 together. By pressing the tubular member 30 in an area proximate tab member 34A inwards toward the hollow interior area 32, the male tab member 34A may disengage from the female channel 34B allowing the tubular member 30 to be opened.

The tubular member 30 may have an aperture 36 formed through a top end of the tubular member 30. The top end may be the end of the tubular member 30 located closest to the lace securement mechanism. The aperture 36 may be formed through the top end and into the hollow interior area 32 of the tubular member 30.

The tubular member 30 may have an aperture 38 formed through a bottom end of the tubular member 30. The bottom end may be the end of the tubular member 30 located closest to the conduit 26. The aperture 38 may be formed through the bottom end and into the hollow interior area 32 of the tubular member 30.

A securing mechanism 40 may be formed in the hollow interior area 32 of the tubular member 30. The securing mechanism 40 may be located proximate the aperture 36. The securing mechanism 40 may be used to secure an item placed through the aperture 36 within the hollow interior area 32 of the tubular member 30 as may be disclosed below. More specifically, an end section of a shoe lace 44 as may be shown below.

The lace securement system 20 may have a strap 42. In accordance with one embodiment, the strap 42 may be elastic in nature thereby allowing the strap 42 to expand and contract in size. The strap 42 may be placed and held within the conduit 26. Each end of the strap 42 may have a cap 42A formed thereon. In accordance with one embodiment, the cap 42A may be semi-spherical in shape. The cap 42A may prevent the strap 42 from being removed from the conduit 26 and securing clasp 28 when a force is applied.

In operation, each end of the shoe lace 44 may be run through a respective the lace securement mechanism on each side of the shoe 22 such that the shoe lace 44 is secured between the protrusions 5 of the two disc-shaped edges 15. Each end of the shoe lace 44 may be knotted.

The securing clasp 28 on each side of the shoe 22 may be opened and each end of the shoe lace 44 may be placed within the hollow interior area 32 of the tubular member 30 so that the shoe lace 44 may run through the aperture 36. The aperture 36 may be sized to prevent the knotted end of the shoe lace 44 from slipping thorough the aperture 36 when the securing clasp 28 is closed. However, to further prevent the knotted end of the shoe lace 44 from slipping thorough the aperture 36, the securing mechanism 40 may hold the knotted end of the shoe lace 44 within the hollow interior area 32 of the tubular member 30 when the securing clasp 28 is closed.

The strap 42 may be placed within the hollow interior area 32 of the tubular member 30 so that the strap 42 may run through the aperture 38 when the securing clasp 28 on each side of the shoe 22 is opened. The cap 42A may be used to keep the strap 42 within the securing clasp 28 by preventing the strap 42 from slipping thorough the aperture 38 when the securing clasp 28 is closed.

Figure 9:
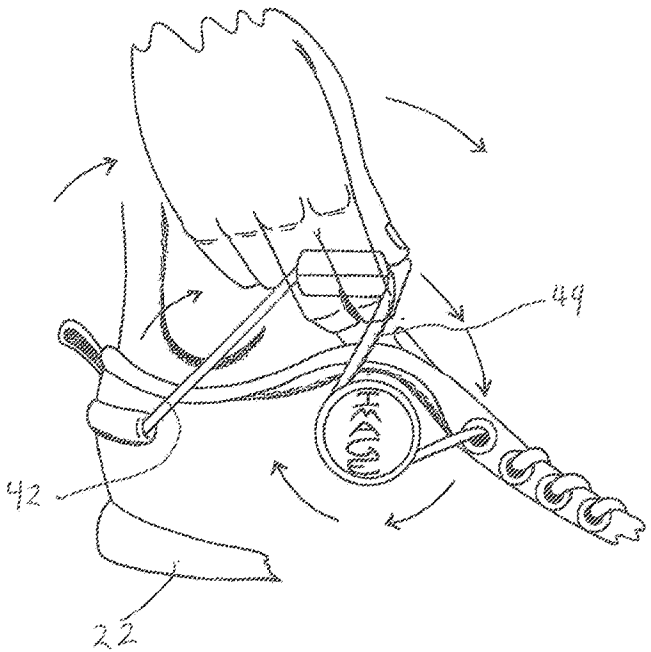
FIG. 9: is a perspective view of an exemplary embodiment of the lace securement system of FIG. 4 tightening shoe laces in accordance with one embodiment of the present invention.

As may be seen in FIG. 9, a user may pull the securing clasp 28 located on each side of the shoe 22 up and around in a clockwise manner and wraps the shoe laces 44 around the securing mechanism on each side of the shoe 22. The elastic nature of the strap 42 allows the user to pull and rotate the strap 42 which in turns pulls and tightens the shoe lace 44 within the shoe 22. Once the shoe lace 44 is at a desired tension level, the user may release the securing clasp 28. The elastic nature of the strap 42 returns the securing clasp 28 to a position proximate the side of the shoe 22. The elastic nature of the strap 42 which runs through the hollow tube and maintains the desired level of tension in the shoe lace 44 by applying pull force to each shoe lace head via the securing clasp.

In view of the foregoing discussion, it may be readily understood that alternative embodiments are contemplated. Having thus described different embodiments of the invention, other variations and embodiments that do not depart from the spirit of the invention will become readily apparent to those skilled in the art. The scope of the present invention is thus not limited to any one particular embodiment, but is instead set forth in the appended claims and the legal equivalents thereof.

What is claimed is:

1. A shoe lace securement system comprising:

a pair of shoe lace securing mechanisms, one of the pair of shoe lace securing mechanisms attached to an upper wall of a shoe on opposing sides of the shoe, wherein each of the pair of shoe lace securing mechanisms comprises:

a spool having a pair of circular discs connected together, wherein inward facing walls of each of the pair of circular discs have a plurality of protrusions, wherein the plurality of protrusions on a first circular disc of the pair of circular discs align with a plurality of protrusions on a second circular disc of the pair of circular discs; and a hollow tube centrally located on the pair of circular discs and connecting the pair of circular discs;

a conduit attached to an upper rear area of the shoe;

a stretchable strap inserted in the conduit;

a cap member attached to each end of the stretchable strap; and a pair of securing clasps, wherein each of the securing clasp comprises:

a tubular member having a hollow interior, the tubular member cut along a first horizontal edge through the hollow interior to a second horizontal edge, the tubular member hingedly coupled at the second horizontal edge;

a first opening formed through a top surface of the tubular member and in communication with the hollow interior, and a second opening formed through a bottom surface of the tubular member and in communication with the hollow interior;

wherein each end of a shoe lace runs through a respective one of the pair of shoe lace securing mechanism on each side of the shoe and secured between the plurality of protrusions on the first circular disc and the plurality of protrusions on the second circular disc and into the first opening of the tubular member of a respective securing clasp, the respective securing clasp securing a respective end of the shoe lace within securing clasp when the securing clasp is closed;

wherein each end of the stretchable strap runs through the second opening of the tubular member of a respective securing clasp, the respective securing clasp securing a respective end of the stretchable strap within securing clasp when the securing clasp is closed.

2. The shoe lace securement system of claim 1, wherein the conduit is formed of a flexible material.

3. The shoe lace securement system of claim 1, wherein the conduit is attached to an upper rear surface area of the shoe and aligned with the pair of shoe lace securing mechanisms.

4. The shoe lace securement system of claim 1, wherein the conduit extends around a circumference of a heel of the shoe.

5. The shoe lace securement system of claim 1, wherein tubular member has a flat rear surface.

6. The shoe lace securement system of claim 1, comprising a latch formed on the first horizontal edge of the tubular member.

7. The shoe lace securement system of claim 6, wherein the latch comprises:

a male tab formed on a first surface of the first horizontal edge; and a female channel formed on a second surface of the first horizontal edge opposing the first surface, the female channel aligned with the male tab when the securing clasp is closed.

8. The shoe lace securement system of claim 1, wherein pulling and rotating the pair of securing clasps clockwise tightens the shoe lace within the shoe, the stretchable strap maintaining a desired level of tension in the shoe lace.

9. A shoe lace securement system comprising:

a pair of shoe lace securing mechanisms, one of the pair of shoe lace securing mechanisms attached to an upper wall of a shoe on opposing sides of the shoe, wherein each of the pair of shoe lace securing mechanisms comprises:

a spool having a pair of circular discs connected together, wherein inward facing walls of each of the pair of circular discs have a plurality of protrusions, wherein the plurality of protrusions on a first circular disc of the pair of circular discs align with a plurality of protrusions on a second circular disc of the pair of circular discs; and a hollow tube centrally located on the pair of circular discs and connecting the pair of circular discs;

a conduit attached to an upper rear area of the shoe and aligned with the pair of shoe lace securing mechanisms, the conduit extending around a circumference of a heel of the shoe;

a stretchable strap inserted in the conduit;

a cap member attached to each end of the stretchable strap; and a pair of securing clasps, wherein each of the securing clasp comprises:

a tubular member having a hollow interior, the tubular member cut along a first horizontal edge through the hollow interior to a second horizontal edge, the tubular member hingedly coupled at the second horizontal edge;

a latch formed on the first horizontal edge of the tubular member for locking the tubular member in a closed position and unlocking the tubular member to open the tubular member, a first opening formed through a top surface of the tubular member and in communication with the hollow interior, and a second opening formed through a bottom surface of the tubular member and in communication with the hollow interior;

wherein each end of a shoe lace runs through a respective one of the pair of shoe lace securing mechanism on each side of the shoe and secured between the plurality of protrusions on the first circular disc and the plurality of protrusions on the second circular disc and into the first opening of the tubular member of a respective securing clasp, the respective securing clasp securing a respective end of the shoe lace within securing clasp when the securing clasp is closed;

wherein each end of the stretchable strap runs through the second opening of the tubular member of a respective securing clasp, the respective securing clasp securing a respective end of the stretchable strap within securing clasp when the securing clasp is closed.

10. The shoe lace securement system of claim 9, wherein the conduit is formed of a flexible material.

11. The shoe lace securement system of claim 9, wherein tubular member has a flat rear surface.

12. The shoe lace securement system of claim 9, wherein the latch comprises:

a male tab formed on a first surface of the first horizontal edge; and a female channel formed on a second surface of the first horizontal edge opposing the first surface, the female channel aligned with the male tab when the securing clasp is closed.

13. The shoe lace securement system of claim 9, wherein pulling and rotating the pair of securing clasps clockwise tightens the shoe lace within the shoe, the stretchable strap maintaining a desired level of tension in the shoe lace.

14. A shoe lace securement system comprising:

a pair of shoe lace securing mechanisms, one of the pair of shoe lace securing mechanisms attached to an upper wall of a shoe on opposing sides of the shoe, wherein each of the pair of shoe lace securing mechanisms comprises:

a spool having a pair of circular discs connected together, wherein inward facing walls of each of the pair of circular discs have a plurality of protrusions, wherein the plurality of protrusions on a first circular disc of the pair of circular discs align with a plurality of protrusions on a second circular disc of the pair of circular discs; and a hollow tube centrally located on the pair of circular discs and connecting the pair of circular discs;

a conduit attached to an upper rear area of the shoe and aligned with the pair of shoe lace securing mechanisms, the conduit extending around a circumference of a heel of the shoe and formed of a flexible material;

a stretchable strap inserted in the conduit;

a cap member attached to each end of the stretchable strap; and a pair of securing clasps, wherein each of the securing clasp comprises:

a tubular member having a hollow interior, the tubular member cut along a first horizontal edge through the hollow interior to a second horizontal edge, the tubular member hingedly coupled at the second horizontal edge;

a latch formed on the first horizontal edge of the tubular member for locking the tubular member in a closed position and unlocking the tubular member to open the tubular member, a first opening formed through a top surface of the tubular member and in communication with the hollow interior, and a second opening formed through a bottom surface of the tubular member and in communication with the hollow interior, wherein each end of a shoe lace runs through a respective one of the pair of shoe lace securing mechanism on each side of the shoe and secured between the plurality of protrusions on the first circular disc and the plurality of protrusions on the second circular disc and into the first opening of the tubular member of a respective securing clasp, the respective securing clasp securing a respective end of the shoe lace within securing clasp when the securing clasp is closed;

wherein each end of the stretchable strap runs through the second opening of the tubular member of a respective securing clasp, the respective securing clasp securing a respective end of the stretchable strap within securing clasp when the securing clasp is closed;

wherein pulling and rotating the pair of securing clasps clockwise tightens the shoe lace within the shoe, the stretchable strap maintaining a desired level of tension in the shoe lace.

15. The shoe lace securement system of claim 14, wherein tubular member has a flat rear surface.

16. The shoe lace securement system of claim 14, wherein the latch comprises:

a male tab formed on a first surface of the first horizontal edge; and a female channel formed on a second surface of the first horizontal edge opposing the first surface, the female channel aligned with the male tab when the securing clasp is closed.

17. The shoe lace securement system of claim 16, comprising:

a conduit attached to an upper rear area of the shoe;

a stretchable strap inserted in the conduit;

a cap member attached to each end of the stretchable strap; and a pair of securing clasps, wherein each of the securing clasp comprises:

a tubular member having a hollow interior, the tubular member cut along a first horizontal edge through the hollow interior to a second horizontal edge, the tubular member hingedly coupled at the second horizontal edge;

a first opening formed through a top surface of the tubular member and in communication with the hollow interior; and a second opening formed through a bottom surface of the tubular member and in communication with the hollow interior, wherein each end of a shoe lace runs through a respective one of the pair of shoe lace securing mechanism on each side of the shoe and secured between the plurality of protrusions on the first circular disc and the plurality of protrusions on the second circular disc and into the first opening of the tubular member of a respective securing clasp, the respective securing clasp securing a respective end of the shoe lace within securing clasp when the securing clasp is closed;

wherein each end of the stretchable strap runs through the second opening of the tubular member of a respective securing clasp, the respective securing clasp securing a respective end of the stretchable strap within securing clasp when the securing clasp is closed.

* * * * *